US007114260B2

(12) United States Patent
Nguyen et al.

(10) Patent No.: US 7,114,260 B2
(45) Date of Patent: Oct. 3, 2006

(54) METHOD AND SYSTEM FOR SIZING FEET AND FITTING SHOES

(75) Inventors: Philip Nguyen, Markham (CA); Becky Hong, Markham (CA)

(73) Assignee: Olly Shoes LLC, Toronto (CA)

( * ) Notice: Subject to any disclaimer, the term of this patent is extended or adjusted under 35 U.S.C. 154(b) by 365 days.

(21) Appl. No.: 10/614,699

(22) Filed: Jul. 8, 2003

(65) Prior Publication Data

US 2004/0073407 A1 Apr. 15, 2004

Related U.S. Application Data

(60) Provisional application No. 60/393,836, filed on Jul. 8, 2002.

(51) Int. Cl.
*A43D 1/02* (2006.01)

(52) U.S. Cl. ..... 33/6; 33/512

(58) Field of Classification Search ..... 33/6, 33/512, 515, 3 R, 3 A, 3 B, 3 C
See application file for complete search history.

(56) References Cited

U.S. PATENT DOCUMENTS 5,128,880 A * 7/1992 White ..... 382/165
5,206,804 A * 4/1993 Thies et al. ..... 705/27
5,237,520 A * 8/1993 White ..... 382/154
5,361,133 A * 11/1994 Brown et al. ..... 356/612
5,539,677 A * 7/1996 Smith ..... 705/26
5,659,395 A * 8/1997 Brown et al. ..... 356/601
5,729,905 A * 3/1998 Mathiasmeier et al. ..... 33/3 R
6,029,358 A * 2/2000 Mathiasmeier et al. ..... 33/3 R
6,289,107 B1 9/2001 Borchers
6,550,149 B1 * 4/2003 Dowdell ..... 33/6
2002/0157266 A1 10/2002 Dowdell
2004/0081336 A1 * 4/2004 Brooks ..... 382/111

FOREIGN PATENT DOCUMENTS

DE 199 22 151 A1 11/2000
GB 1 489 181 10/1977
WO WO 91/17676 11/1991

* cited by examiner

*Primary Examiner*—G. Bradley Bennett
(74) *Attorney, Agent, or Firm*—Bereskin & Parr

(57) ABSTRACT

A system and method for sizing shoes for the foot of a user. A computer is provided that is adapted to receive a digital image of the foot, the computer having stored thereon a software package that includes an image processing component and a foot data component and optionally. The image processing component is adapted for receiving the digital image of the foot and producing a trace outline of the foot. The foot data component is adapted to receive the trace outline and determine foot data from the trace outline. The comparator component is adapted to receive the foot data and generate, based on the foot data, at least one of an indicator of the shoe size of the foot and an indicator of the best fitting shoe from among a plurality of shoes.

22 Claims, 13 Drawing Sheets

METHOD AND SYSTEM FOR SIZING FEET AND FITTING SHOES

FIELD OF THE INVENTION

The present invention relates to shoe sizing systems and more particularly, the invention relates to shoe sizing systems wherein measurements are taken on the wearer's foot and the selected shoe separately.

BACKGROUND OF THE INVENTION

The sizing of shoes is most commonly performed with the well known Brannock device. Generally, the Brannock device is a metal foot measuring device that has sliders with scales printed on either the sliders or the platform on which a consumer places his/her foot for sizing. This device, however, has many serious drawbacks. The Brannock device can be difficult to use correctly and is used incorrectly by many within the shoe sales industry. As well, the device is generally used only to measure the length and width of a foot.

Another problem with the Brannock device is that many manufacturers do not strictly follow the sizing scheme that is used on the Brannock device. For example, a size 20 junior shoe made by one manufacturer may not be exactly the same as a size 20 junior shoe made by another manufacturer With the rise of the Internet, many people can now purchase a broad range of items efficiently and effectively remotely. Another drawback to the Brannock device, however, is that a shoe store or a shoe manufacturer would not typically ship such a device to a consumer for the consumer's convenience of determining their shoe size remotely, or of fitting themselves for shoes remotely.

There exists a need, therefore, for a shoe sizing system that is easy to use and accurate, and that is at least semi-automatic to reduce the chance of human error, enabling a consumer to quickly size a shoe without the need for trying on the shoe. Preferably, this should enable the consumer to size a shoe remotely.

SUMMARY OF THE INVENTION

The invention is directed to a system and method for sizing feet and fitting shoes. The system and method can be used by a user to do at least one of: determining their shoe size, and determining the best fitting shoe from among a plurality of shoes. The system and method permit the user to automatically generate information at least partially automatically, reducing the requirement for human involvement in the shoe fitting process.

In a first aspect, the invention is directed to a method of sizing shoes on a foot, comprising:

obtaining a digital image of the foot; obtaining a trace outline of the foot from the digital image;

deriving foot data from the trace outline;

comparing the foot data to corresponding data for a plurality of shoes; and outputting an indicator of the best fitting shoe from the plurality of shoes based on the results of the comparison.

In a second aspect, the invention is directed to a method of sizing shoes on a foot, comprising:

obtaining a digital image of the foot;

obtaining a trace outline of the foot from the digital image;

deriving foot data from the trace outline; and outputting an indicator of shoe size based on the foot data.

In a third aspect, the invention is directed to a system for sizing shoes for the foot of a user. The system includes a computer adapted to receive a digital image of the foot. The computer has stored thereon a software package that includes an image processing component and a foot data component. The image processing component is adapted for receiving the digital image of the foot and producing a trace outline of the foot. This foot data component is adapted to receive the trace outline and determine foot data from the trace outline.

In a preferred embodiment of the third aspect, the software package has a comparator component and the comparator component is adapted to receive the foot data and generate, based on the foot data, at least on of an indicator of the shoe size of the foot and an indicator of the best fitting shoe from among a plurality of shoes.

DESCRIPTION OF THE DRAWINGS

For a better understanding of the present invention and to show more clearly how it may be carried into effect, reference will now be made by way of example to the accompanying drawings, in which.

DESCRIPTION OF THE PREFERRED EMBODIMENT

Figure 1:
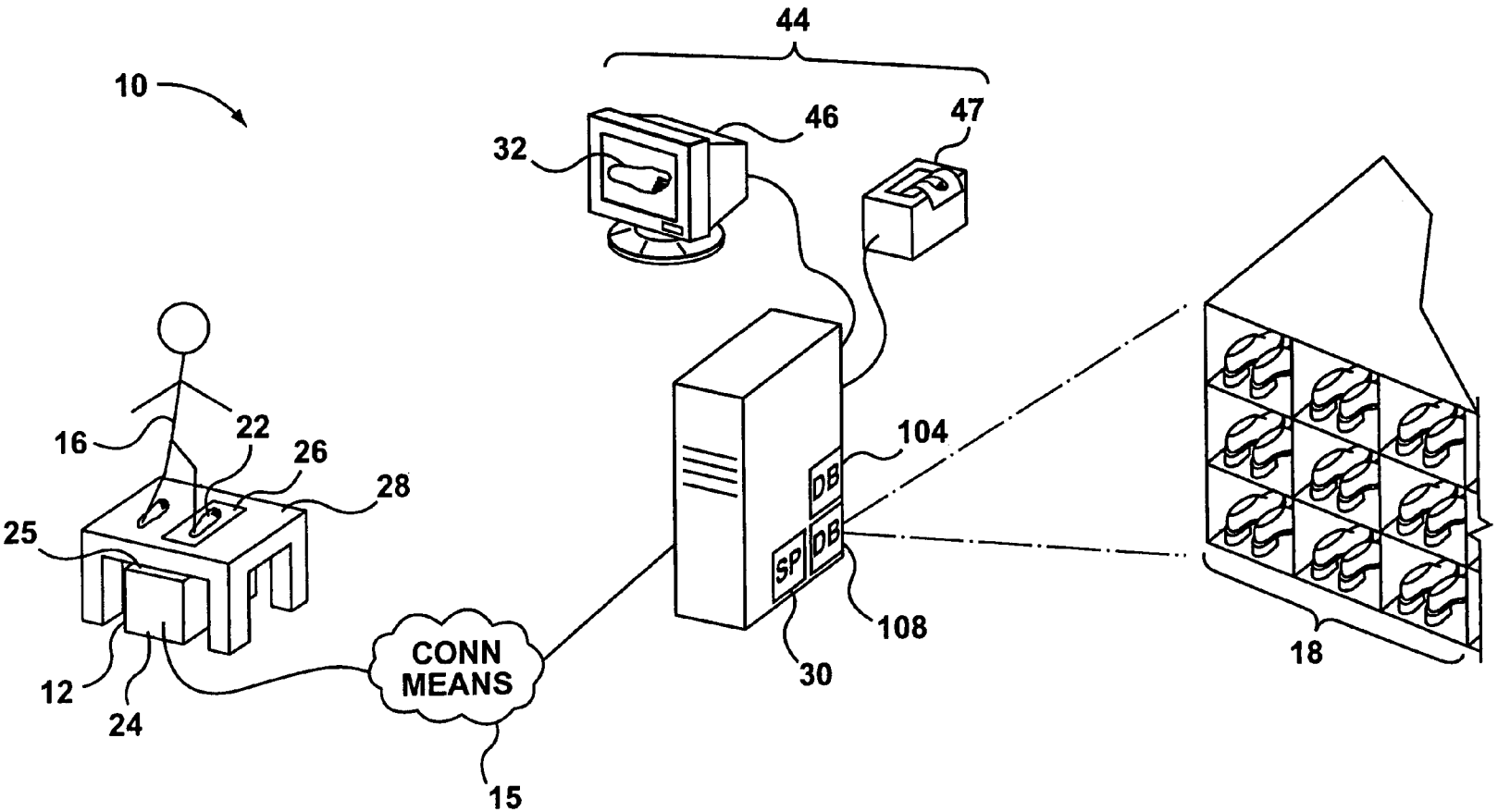
FIG. 1 is a schematic view of a shoe sizing system in accordance with a first embodiment of the present invention.

Reference is made to FIG. 1, which shows a shoe sizing system 10 in accordance with a first embodiment of the present invention. The shoe sizing system 10 includes an input device 12 and a shoe sizing computer 14, which are connected by a connection means 15. Using the input device 12 and the computer 14, the shoe sizing system 10 is adapted to determine at least one of the shoe size of a user 16 and to determine the best fitting shoe from among a plurality of shoes 18.

The input device 12 may be any suitable input device that permits the user 16 to input a digital image 20 of their foot 22 to the computer 14. For example, the input device 12 may be a flatbed scanner 24. The flatbed scanner 24 has a scanning surface 25 on or which above which the user 25 can place their foot 22 for scanning. The scanner 24 can scan the user's foot 22, to produce the image 20 of the foot 22, and can transmit the image 20 to the computer 14 through the connection means 15.

A foot support surface 26 may be provided above the scanner 22 to support some or all of the weight of the user 16 during the scanning step. The foot support surface 26 may be made from, for example, suitably thick glass or some other strong transparent material. The foot support surface 26 may be supported on any suitable structure such as a platform 28 and is positioned above the scanning surface 25 of th scanner 24. During scanning the user 16 can place their foot 22 on the foot support surface 26, and the scanner scans the foot 22 through the foot support surface 26. Alternatively, the scanner 22 may be modified to incorporate the foot support surface 26 directly therein, so that the foot support surface 26 is the scanning surface 25 itself, rather than being positioned above the scanning surface.

Figure 2:
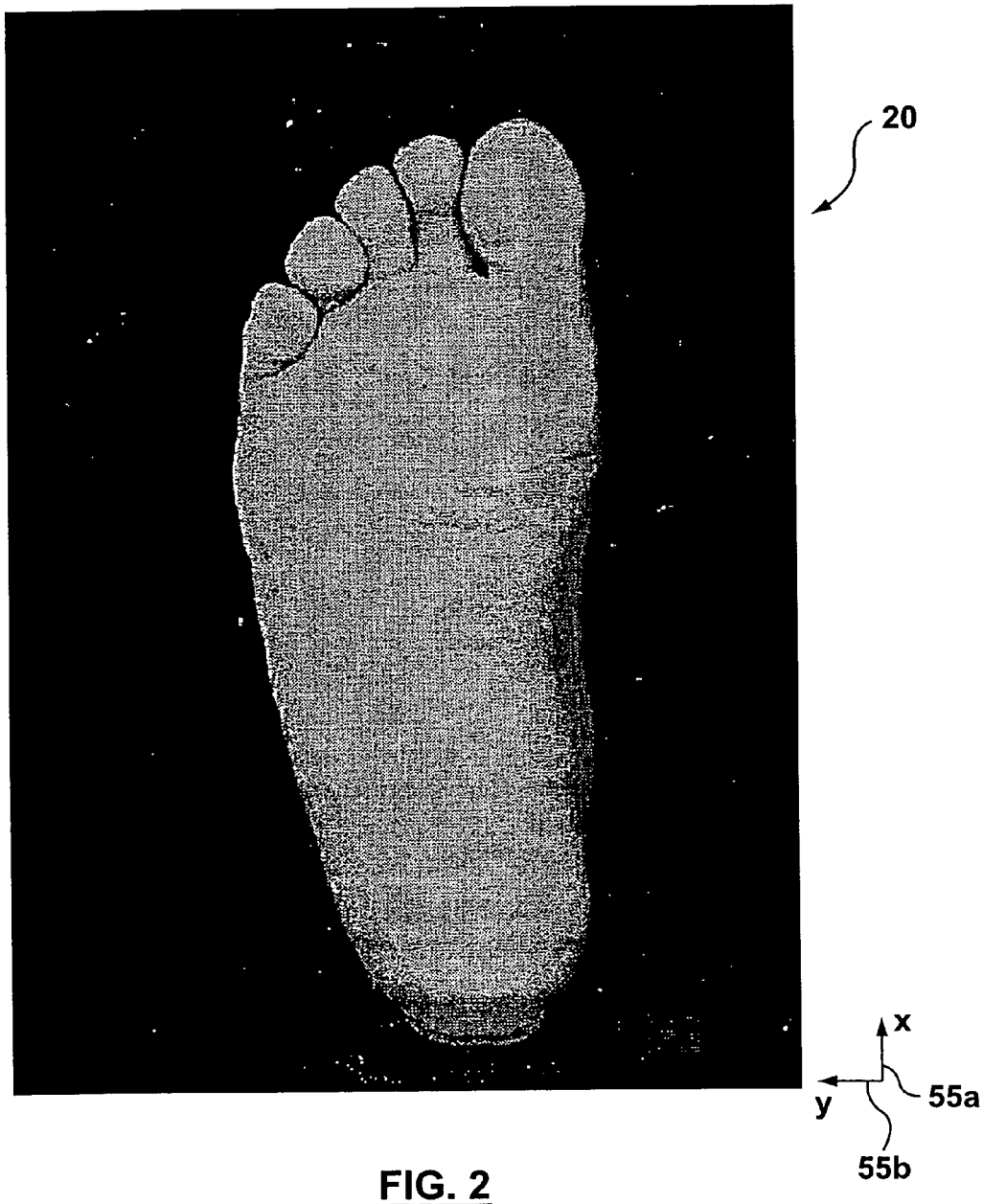
FIG. 2 is a sample scanned image of a foot, that can be used as input to a shoe sizing software package that is part of the shoe sizing system shown in FIG. 1.

A sample image 20 that can be transmitted to the computer 14 from the input device 20 is shown in FIG. 2. The image 20 shows the bottom of the user's foot 22. The image 20 may be a colour image or a black-and-white image. As can be seen in the image 20 a portion of the user's foot 22 actually touches the scanning surface 25 or the foot support surface 26, and a portion does not touch the surface 25 or 26. In particular the outer edge of the user's foot 22 is gradually darker where the foot 22 curves away from the surface 25 or 26.

Figure 3:
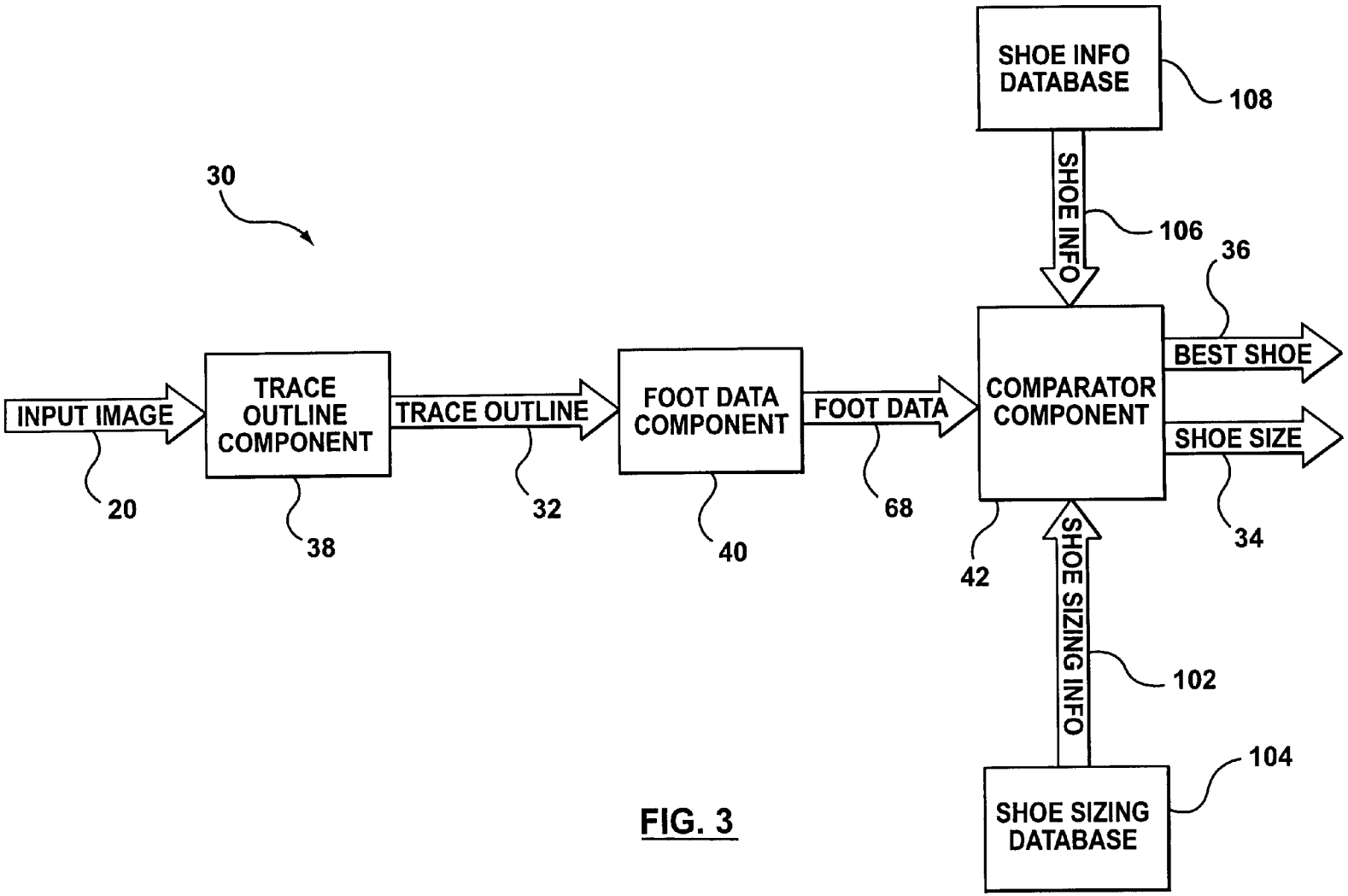
FIG. 3 is a block diagram of the shoe sizing software package that is part of the shoe sizing system shown in FIG. 1.

Reference is made to FIG. 3. A shoe sizing software package 30 on the shoe sizing computer 14 receives the input image 20 from the input device 12 and processes the input image 20 to produce a trace outline 32 of the user's foot 22 and at least one of an indicator 34 of the user's shoe size and an indicator 36 of the best fitting shoe from the plurality of shoes 18.

The software package 30 includes an image processing component 38, a foot data component 40 and a comparator component 42. The image processing component 38 processes the image 22 to produce the trace outline 32. The trace outline 32 of the user's foot 22 may be outputted to one or more suitable visual output devices 44, such as a monitor 46, or a printer 47.

Figure 4:
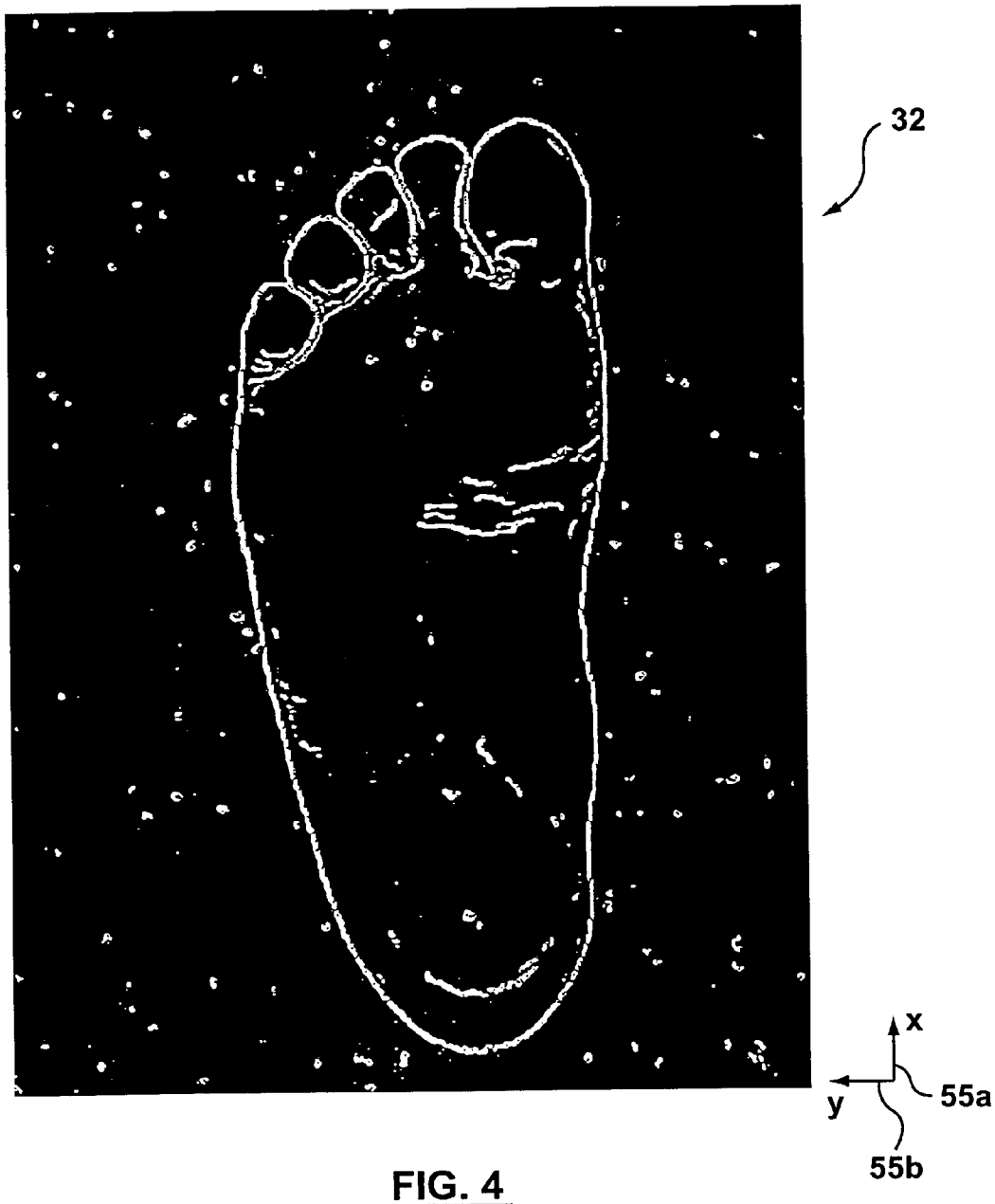
FIG. 4 is a trace outline of a foot, generated from the scanned image shown in FIG. 2.

Reference is made to FIG. 4, which shows a sample trace outline 32 made from the input image 20 shown in FIG. 2. The foot outline in the trace outline 32 corresponds generally to the outermost edge of the user's foot 22. The trace outline 32 contains virtually the same shoe sizing information as the original input image 20 but requires less computer memory to store. Furthermore, because of its smaller memory size, the trace outline 32 can be handled by the computer 14 much more quickly and easily than the input image 20. Furthermore, the trace outline 32 is more quickly transmitted between computers and other devices on a network or over the Internet The trace outline 32 may have several uses. For example, the computer 14 may store a number of trace outlines 32 from the user 16 which were taken over the course of the user's life. If the user 16 is a child for example, they will experience relatively rapid changes in their foot size. The computer 14 can store the trace outline 32 of the child each time the child is sized using the shoe sizing system 10. At any given time, all of the historical trace outlines 32 for the child can be printed or shown together to show visually the progressive growth of the child's foot 22.

Alternatively to storing the trace outline 32, the software package 30 may instead choose a selected number of points along the outline of the foot 22 in the trace outline 32 and may store only the coordinates of those points. When required, the software package 30 can then 'rebuild' the foot outline by drawing the stored points and drawing curves, such as B-spline curves to connect the points. The software package 30 may sample points more frequently in some areas then others, particularly where there are rapid changes in the outline, such as in the toe area. The software package 30 may sample points less frequently in some portions of the foot outline, such as in the inside arch region for example.

Figure 5:
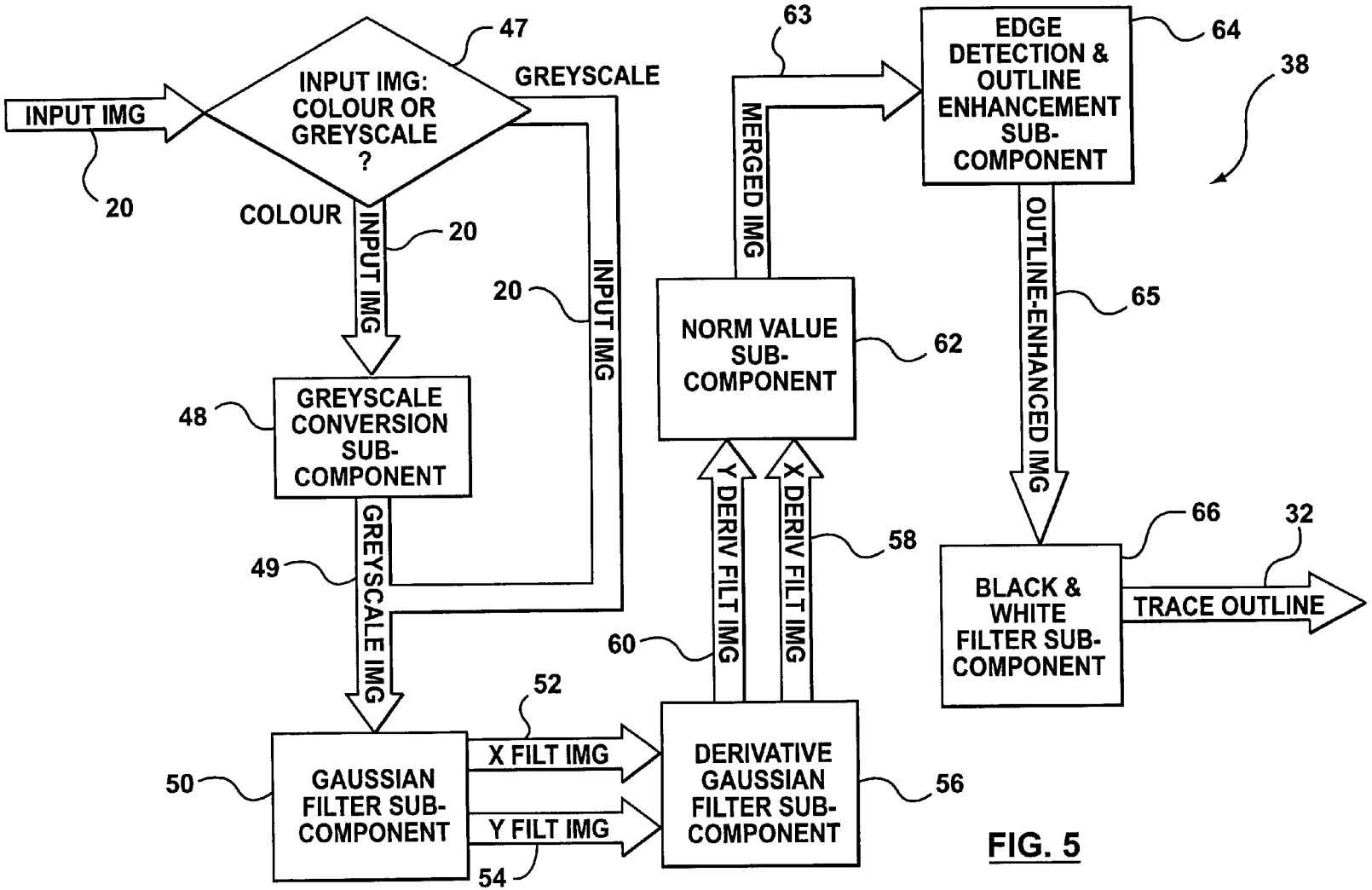
FIG. 5 is block diagram of an image processing component of the shoe sizing software package shown in FIG. 3.

Reference is made to FIG. 5, which shows the image processing component 38 in more detail. The image processing component 38 first determines if the input image 20 is in colour or greyscale at a check-step 47. If the input image 20 is in colour then it is sent to a greyscale conversion sub-component 48 where the image 20 is converted into a greyscale image 49. If the input image 20 is already in greyscale initially, then the image processing component 38 may bypass the greyscale conversion sub-component 48 since it is not required.

The image processing component 38 can produce the trace outline 32 from the greyscale image 49 in a number of ways. For example, the image processing component 38 may include a first, Gaussian filter sub-component 50 to reduce 'noise' that may be present in the input image 20. The Gaussian filter sub-component 50 applies a Gaussian filter in each of the X and Y directions (see FIG. 2) to produce an X-Gaussian-filtered image 52 and a Y-Gaussian-filtered image 54 each of which have reduced noise relative to the original input image 20.

The X and Y directions are the directions that are parallel to a set of X and Y axes 55*a* and 55*b* that are orthogonal to each other. It is presumed at least initially that in the original input image 20 the longitudinal and lateral directions of the foot 22 are aligned with the X and Y axes 55*a* and 55*b*. The term 'longitudinally' refers to the direction in which the foot 22 is adapted to walk forwardly (or backwardly). The term 'laterally' refers to the direction transverse to the longitudinal direction.

The Gaussian and derivative Gaussian filters may be applied to a particular pixel using any suitable number of pixels on either side of it. For example, the filters may be applied on each pixel using 19 pixels on each side of that pixel in the X or Y direction as the case may be.

These filtered images 52 and 54 may be sent to a derivative Gaussian filter sub-component 56 where edge highlighting filters are applied to the images to highlight the edges of the use's foot 22. The derivative Gaussian filter sub-component 56 may apply, for example, a derivative Gaussian filter in the X and Y directions respectively to the X and Y filtered images 52 and 54, thereby producing X and Y derivative filtered images 58 and 60 respectively.

The X and Y derivative filtered images 58 and 60 may be sent to a norm value sub-component 62. The norm value sub-component 62 merges the X and Y derivative filtered images 58 and 60 into a single merged image 63 as follows. The greyscale value of a given pixel in the merged image 63 may be the average of the corresponding pixel in the X derivative filtered image 58 and the Y derivative filtered image 60 according to any suitable formula, such as the following formula:

$$P_{MERGED}=\sqrt{P_{X\text{-}DERIV\text{-}FILT\text{-}IMG}^2+P_{Y\text{-}DERIV\text{-}FLIT\text{-}IMG}^2}$$

The merged image 63 is sent to an edge detection and outline enhancement sub-component 64 whereby any edges in the merged image 63 are detected and the outline of the user's foot 22 is enhanced to produce an outline-enhance image 65. The edges are detected by comparing each pixel in the merged image 63 with the pixels immediately above and below it and immediately to the left and right of it. If the greyscale value of the pixel being compared is less than that of any of the four neighbouring pixels, then the pixel is determined to not be along an edge line in the merged image 63 and the value of the corresponding pixel in the outline-enhanced image is zero (black). The edge detection and enhancement sub-component 64 is applied on each pixel In the merged image 63 to produce the outline-enhanced image 65. For example, a hypothetical pixel, P(200,400), (whereby the 200 and 400 indicate the pixels position within the merged image 63), is compared to P(199,400), P(201,400), P(200,399) and P(200,401). If in the merged image 63 any of these four pixels has a greyscale value that is greater than that of P(200,400), then the edge detection and outline enhancement sub-component 42 puts a value of zero (black) in for the pixel P(200,400) in the outline-enhanced image 65. By blacking out all the pixels that the edge detection and outline enhancement sub-component 64 determines do not lie along an edge line, the edge lines themselves are enhanced relatively to other pixels in the outline-enhanced image 65.

After the edge detection and outline enhancement sub-component 64, the outline-enhanced image 65 is sent to a black-and-white filter subcomponent 66. The black-and-white filter subcomponent 66 cleans up the outline-enhanced image 65 by blacking out any pixels having a value that is below a selected threshold greyscale value, or alternatively, that are outside of a certain range of greyscale values, thus retaining only the most prominent outlines. Furthermore, the black-and-white filter subcomponent 66 brightens any pixels that are above the selected threshold value to full brightness. Thus, the outline-enhanced image 65, which contains a range of greyscale values is converted to a black-and-white image containing only 'black' pixels and'white' pixels. The black-and-white image is the trace outline image 32.

It will be noted that it is possible that the trace outline 32 may have gaps in it, due to a combination of chance factors such as the positioning of noise and the clarity of the original input image 20.

Referring to FIG. 3, the foot data component 40 receives the trace outline 32 from the image processing component 38 and uses it to produce one or more foot data 68 corresponding to the user's foot 22. The foot data 68 that are produced may be any suitable foot data and may include at least one of the following dimensions of the user's foot: the length, the width, the metatarsal length and the heel width.

Figure 6:
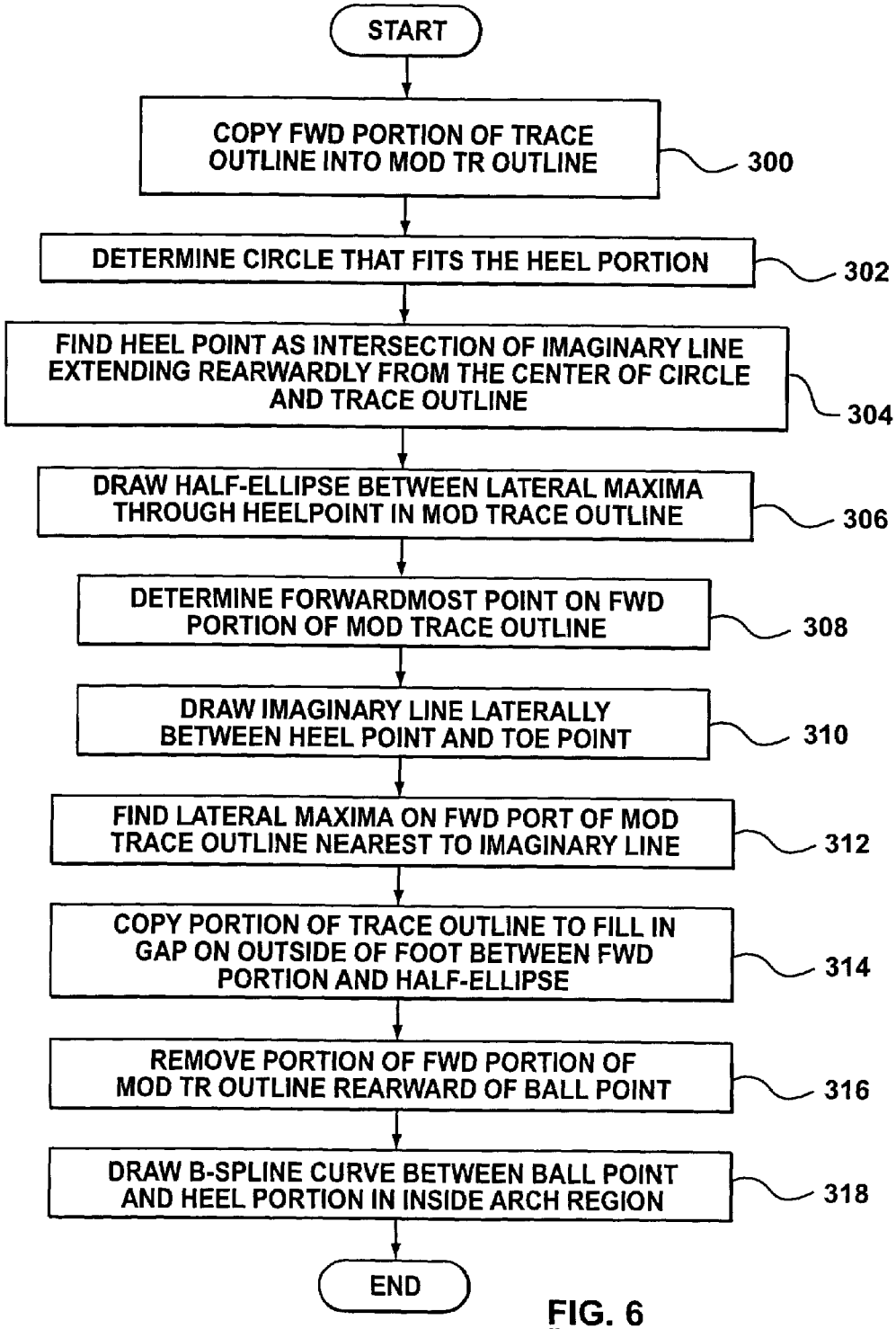
FIG. 6 is a flow diagram of a foot data component of the software package shown in FIG. 3.

Reference is made to FIG. 6. After receiving the trace outline 32, the foot data component 40 may create a modified trace outline 70 and determines a plurality of foot points 72, which are selected points on the user's foot 22 that are useful for determining the foot data 68.

Figure 7:
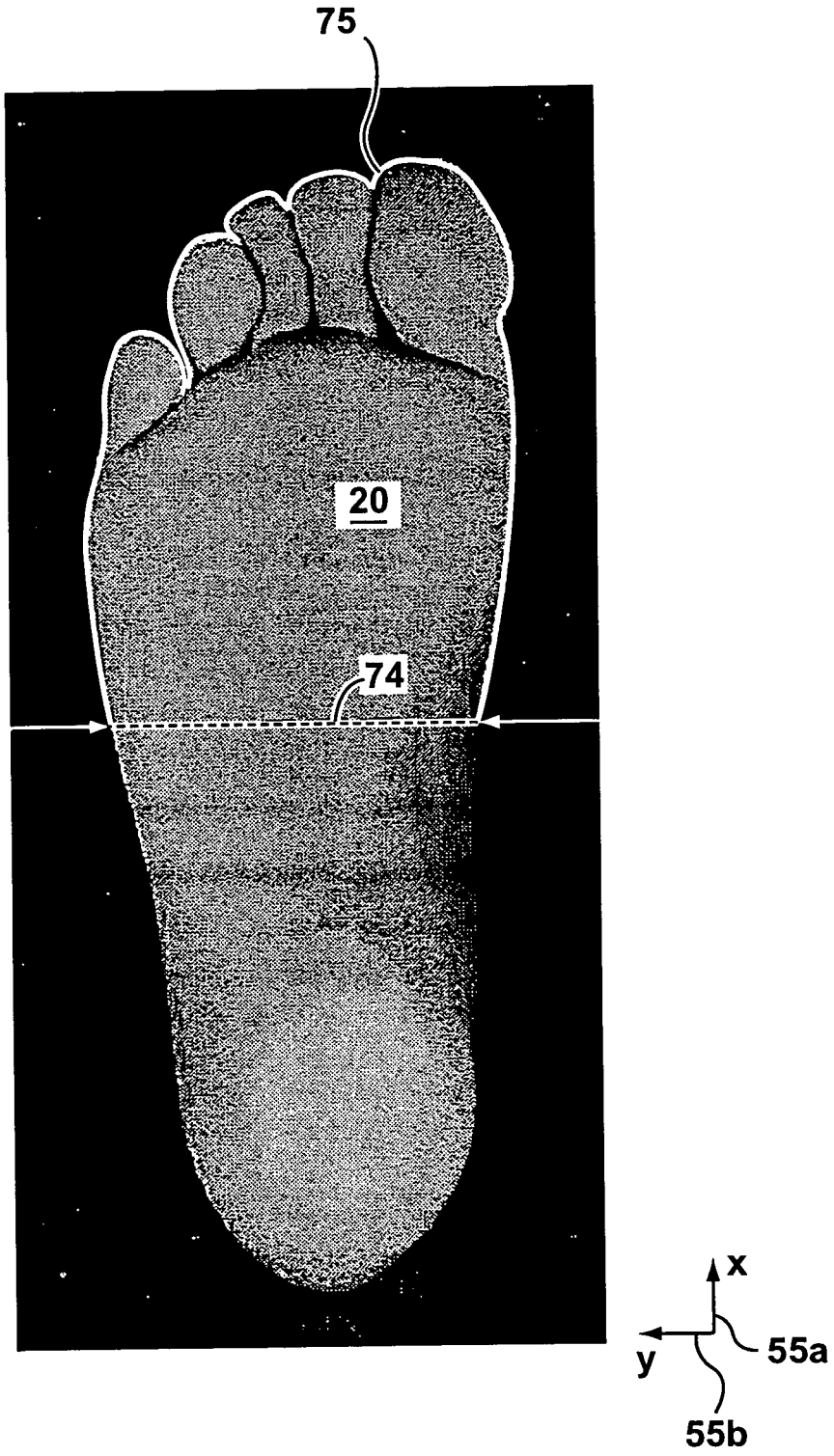
FIG. 7 is a view of the scanned foot image shown in FIG. 2 with a portion of a modified trace outline of the foot generated by the foot data component shown in FIG. 6.

Referring to FIG. 7, to produce the modified trace outline 70, the trace outline 32 is first divided by an imaginary bisector line 74 that extends laterally midway across the trace outline 32. The portion of the trace outline 32 forward of the bisector line 74, (i.e. the portion that includes the toes), is copied at step 300 (see FIG. 6) into the modified trace outline 70 and is shown at 75 in FIG. 7.

Figure 8:
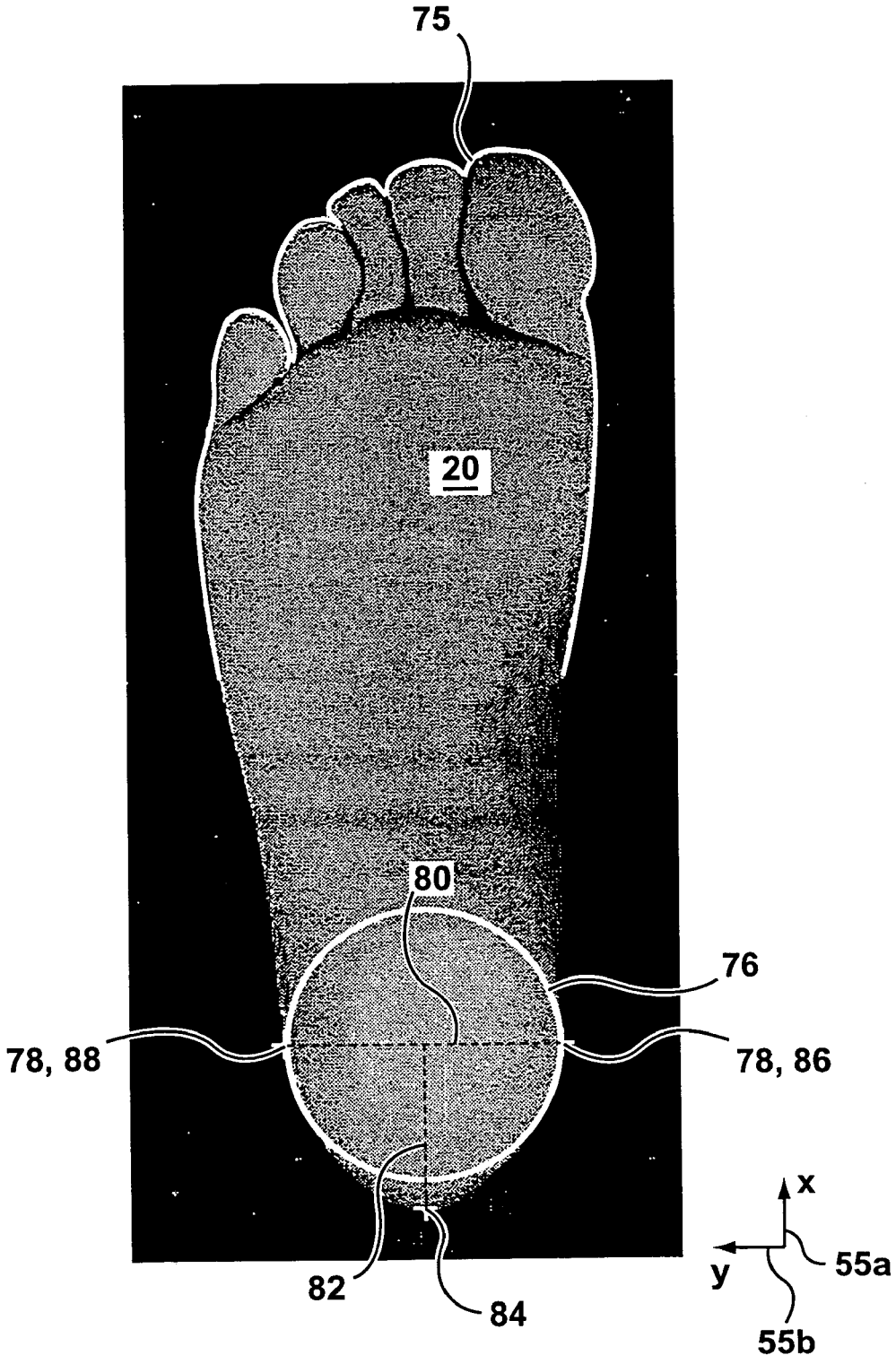
FIG. 8 is a view of the scanned foot image and modified trace outline portion shown in FIG. 7 illustrating the generation of a second portion of the modified trace outline by the foot data component shown in FIG. 6.

At step 302 in FIG. 6, the foot data component 40 determines a circle 76 (see FIG. 8), through a trial and error process, whereby the most points on the circle 76 match up with points along the trace outline 32 and whereby the two lateral maxima, which are shown at 78, match up with points on the trace outline 32.

The foot data component 40 may draw an imaginary line 80 between the lateral maxima 78, thus bisecting the circle 76. At step 304 (see FIG. 6), an imaginary line 82 is drawn extending longitudinally rearwardly from the center of the circle 76 until the line 82 intersects with the trace outline 32. The intersection point of the imaginary line 82 and the trace outline 32 is the rearmost point on the foot 22, which is shown at 84. The rearmost point 84 is also referred to as the heel point 84. The lateral maxima 78 of the circle 76 are the two points that define the width of the heel, and are referred to as the first and second heel points 86 and 88 respectively.

As explained above, it is possible however that the trace outline 32 may be missing some points or outline segments around the perimeter of the foot 22. Thus it is in particular possible for the foot data component 40 to find that there is no intersection between the imaginary line 82 and the trace outline 32. In this case, the foot data component 40 selects the heel point 84 using the original input image 20. The imaginary line 82 is drawn rearwardly until the greyscale values of the original scanned image fall below a selected threshold value indicating that it has reached the edge of the foot.

Figure 9:
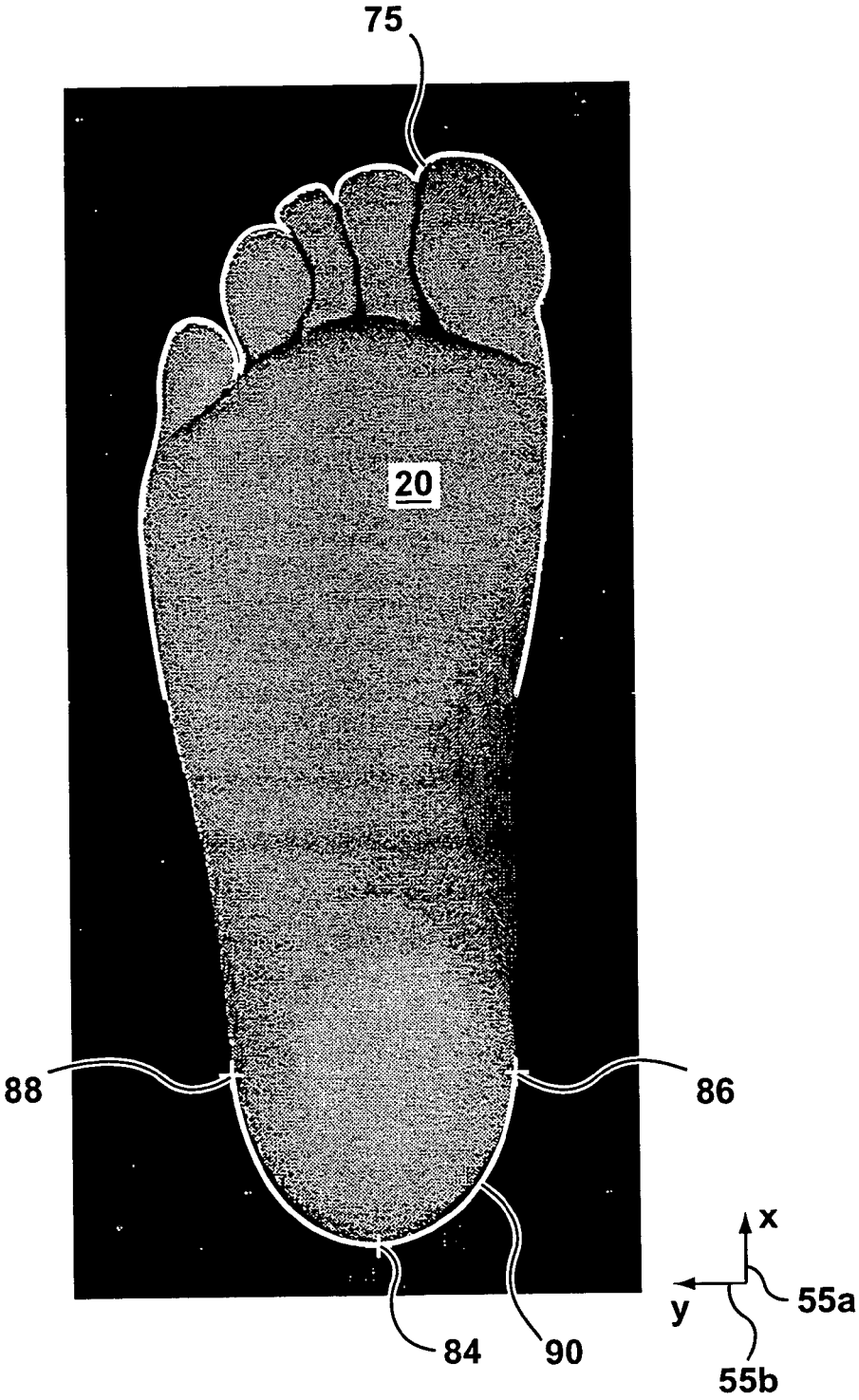
FIG. 9 is a view of the scanned foot image and modified trace outline portion shown in FIG. 7 with the completed second portion of the modified trace outline and three foot points determined by the foot data component shown in FIG. 6.

At step 306 (see FIG. 6) the foot data component 40 draws a half-ellipse using the three points 84, 86 and 88 to define it (see FIG. 9), whereby the ends of the half-ellipse are the heel width points 86 and 88 and the midpoint of the half-ellipse is the heel point 84. The half-ellipse forms a heel portion 90 of the modified trace outline 70.

It is alternatively possible for the foot data component 40 to determine the heel point 86 and the heel width points by any other suitable method. For example, the foot data component 40 could find the heel point by looking for the rearmost point on the trace outline 32, instead of the steps of drawing a line rearwardly from the center of the circle 76.

Figure 10:
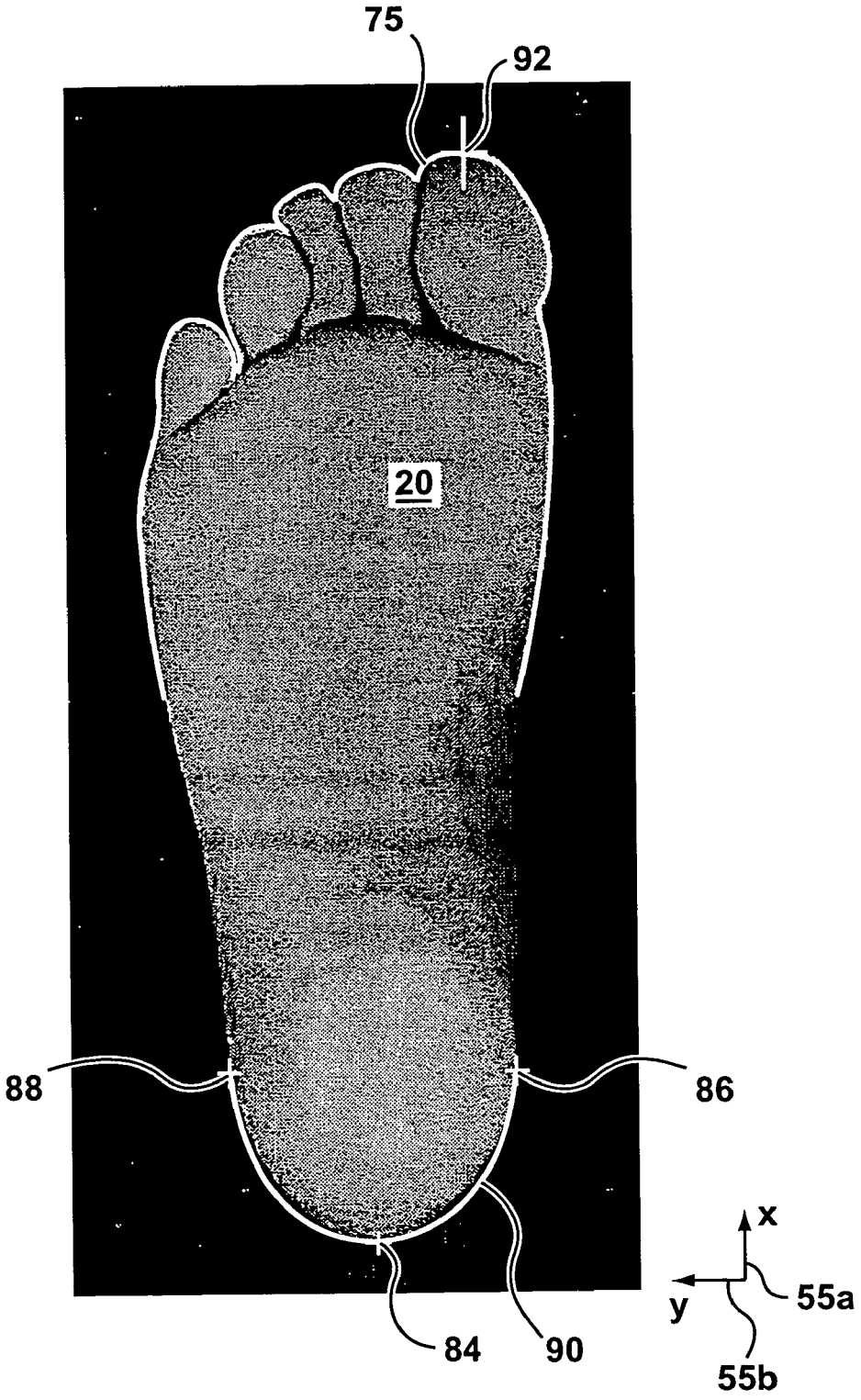
FIG. 10 is a view of the scanned foot image and modified trace outline portions shown in FIG. 9 showing a fourth foot point which is determined by the foot data component shown in FIG. 6.

At step 308, the foot data component 40 determines the forwardmost point (also referred to as the toe point) on the foot 22, which is shown at 92 (see FIG. 10), by determining the forwardmost point along the forward trace-outline portion 75. If there are several contiguous points that are all equally forward, then the foot data component 40 selects a middle point of those points as the toe point 92.

Figure 11:
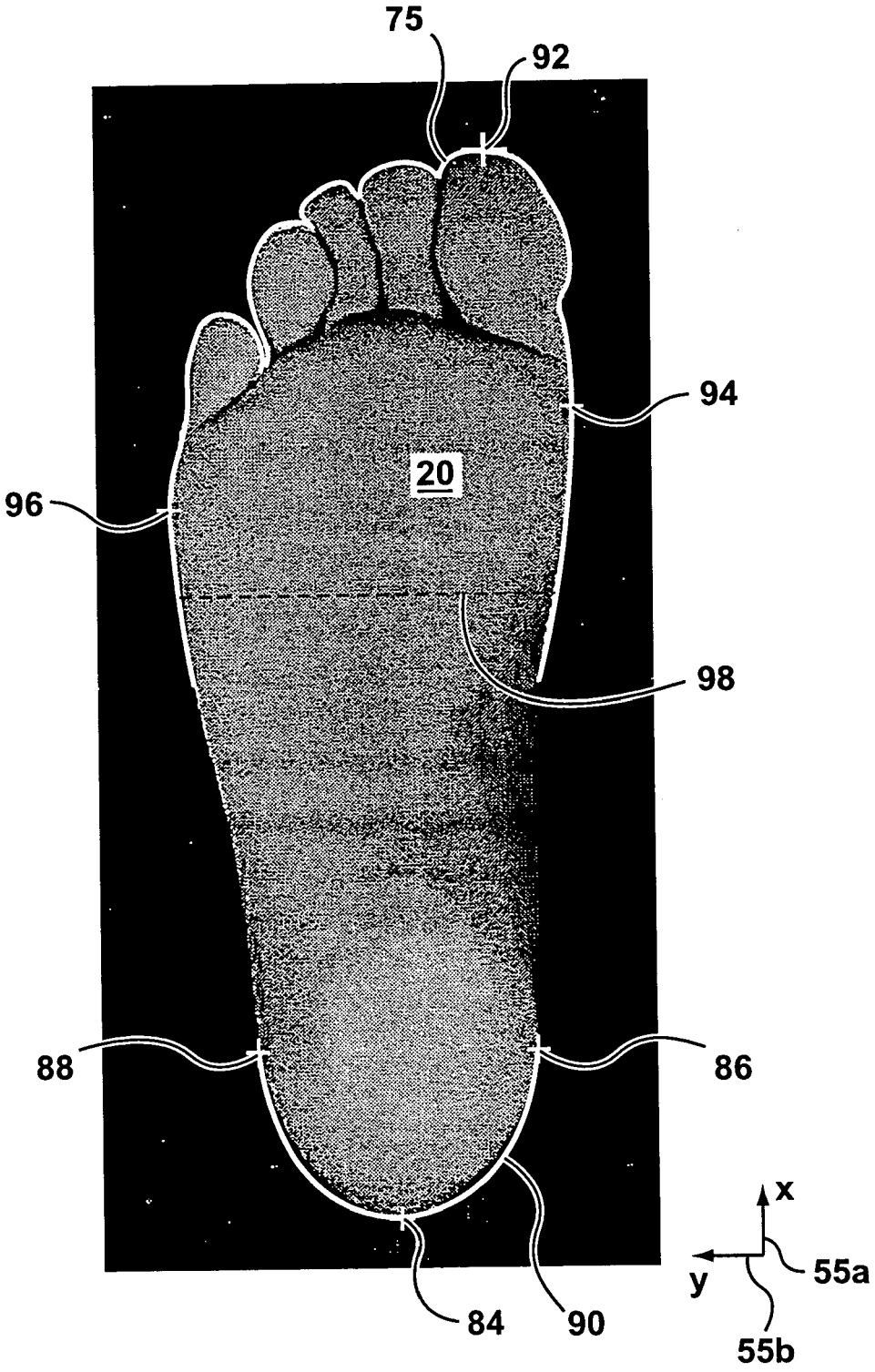
FIG. 11 is a view of the scanned foot image and modified trace outline portions shown in FIG. 10 showing fifth and sixth foot points which are determined by the foot data component shown in FIG. 6.

As shown in FIG. 11, the foot data component 40 determines a ball point 94 and an opposing width point 96 by first drawing at step 310 (see FIG. 6) an imaginary line 98 laterally across the foot two-thirds of the distance from the heel point 84 towards the toe point 92. At step 312, the foot data component 40 looks for the two lateral maxima on the forward trace-outline portion 75 that are nearest to the imaginary line 98. These maxima are the ball point 94 on one side of the foot 22 and the opposing width point on the other side of the foot 22. If there are several contiguous points that are all equal maxima on either the inside or outside of the foot 22, then the foot data component 40 uses a middle point of these contiguous points for the ball point 94 or the opposing width point 96, as the case may be.

Figure 12:
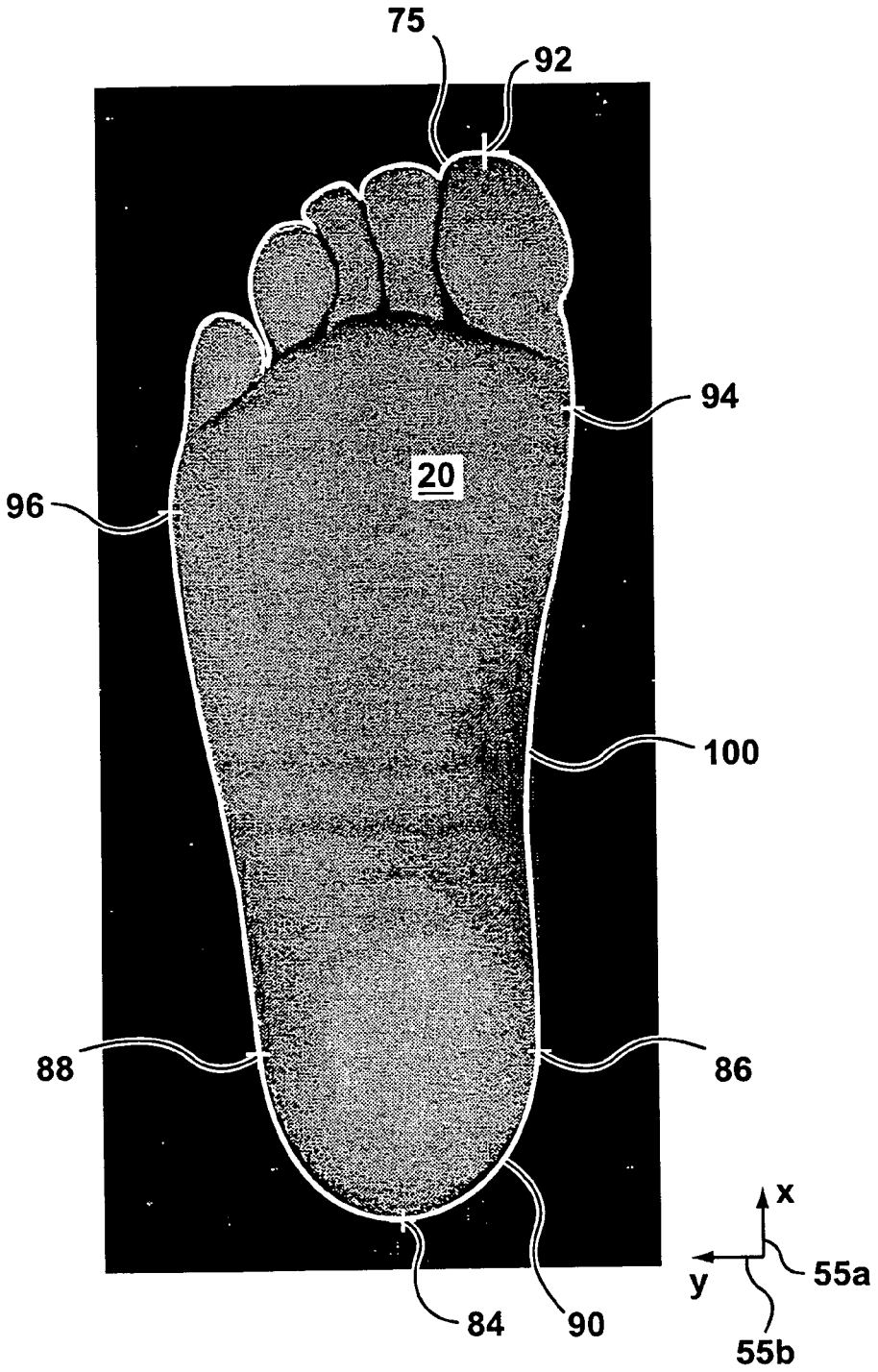
FIG. 12 is a view of the scanned foot image and completed modified trace outline portions generated by the foot data component shown in FIG. 6.

At step 314 (see FIG. 6) the foot data component 40 copies a portion of the trace outline 32 into the modified trace outline 70 to fill in the gap on the outside of the foot 22, between the forward trace outline portion 75 and the heel portion 90 (see FIG. 12). At step 316 (see FIG. 6) for the gap on the inside of the foot 22, the foot data component 40 removes the portion of the forward trace outline portion 75 that is rearward of the ball point 94, and at step 318, applies a B-spline curve, to make up an inside arch portion 100, between the ball point 94 and the first heel width point 86.

It will be noted that the inside arch portion 100 and the heel portion 90 do not match up exactly with the corresponding portions in the trace outline 32. It is not necessary for the purposes of this invention that the arch portion 100 match exactly the trace outline 32, for several reasons. The heel portion 90 on the modified trace image 70 presents a more uniform, more consistently shaped curve for the heel of the foot 22 than does the trace outline 32. This is because the trace outline 32 is produced using edge detection techniques from the input image 20, and is thus susceptible to irregularities caused by noise in the input image 20, and due to the imperfect nature of using edge detection, particularly on rounded objects that lack a defined edge, such as the human foot. By contrast, the heel portion 90 is produced using a half-ellipse and is thus relatively smooth and free of irregularities compared to the trace outline 32. It will be noted that the heel point 84 and the first and second heel width points 86 and 88 are points that are the same on both the trace outline 32 and modified trace outline 70.

The inside arch portion 100 may not match up with the trace outline 32 at any points except the end points i.e. the ball point 94 and the first heel width point 86. It has been observed that the trace outline 32 itself in the region of the inside arch of the foot 22 may be prone to inaccuracies and irregularities due to the curvature of the foot 22 away from the scanning surface 25 or support surface 26. Thus, the inside arch portion 100 can be used to provide a smoother, more consistent representation of the inside arch region of the user's foot 22. It will be noted that no loss of accuracy occurs with the ball point 94 and the first heel width point 86 because the inside arch portion 100 and the trace outline 32 coincide on these two points.

The heel point 84, the first and second heel width points 86 and 88, the toe point 92, the ball point 94 and the opposing width point 96 make up the foot point 72. The foot points 72, however, may alternatively include more or fewer points depending on the desired accuracy of the shoe sizing system 10 in sizing shoes for the user 16.

It is alternatively possible for the foot data component 40 to determine all of the foot points 72 using only the trace outline 32. In this alternative, there is no need to generate the modified trace outline 70.

The foot data component 40 uses the foot points 72 to determine the foot data 68. The foot data component 40 determines the foot length for the user's foot 22, by determining the longitudinal distance between the toe point 92 and heel point 84. The foot width is determined by the lateral distance between the ball point 94 and the opposing width point 96. The metatarsal length or ball length is determined by the longitudinal distance between the ball point 94 and the heel point 84. The heel width is determined as the lateral distance between the first and second heel width points 86 and 88.

The software package 30 may display the modified trace outline 70 to the user 16 or to store personnel for example to permit the user 16 (or the store personnel) to rotate the modified trace outline 70 as necessary to better align it with the X and Y axes 55*a* and 55*b*. Poor alignment of the outline 70 with the X and Y axes 55*a* and 55*b* reduces the accuracy of the foot points 72 and of the foot data 68. It is optionally possible that the user 16 (or the store personnel) may rotate the original input image 20 or the trace outline 32, or any other suitable representative image of the user's foot 22. Also optionally, after correction of the alignment, the software package 30 may resubmit the image 49 for filtering and subsequent determination of the foot data 68. Preferably, the degree of rotation required may be any suitable amount, however it is preferably small to reduce any distortion of the image that may be caused by the rotation itself.

The foot data component 40 may also optionally permit the user 16 to move the foot points 72 that were selected by the software package 30. Thus, in the unlikely event that one or more foot points 72 appear to be positioned incorrectly by the software package 30, the user 16 (or store personnel) can adjust their positions before the software package processes the foot points 72 and generates the foot data 68.

For either of the optional rotational adjustment or point position adjustment capabilities discussed above, the software package 30 may alternatively display the trace outline 32 to the user 16 instead of displaying the modified foot outline 70 to the user 16. In this alternative, the foot data component 40 may not generate the modified trace outline 70 itself, but may still use the above described method for determining the foot points 72. Furthermore, the software package 30 may show either the original input image 20 or the greyscale image 49.

The foot data component 40 may output the foot data 68 so that the user 16 is informed of their foot dimensions in standard units of measurement (e.g. Inches or centimeters). It is also possible, as an alternative or in addition to outputting the foot data 68, the foot data component 40 sends the foot data to the comparator component 42. The comparator component 42 may optionally use the foot data 68 to determine and output the indicator 34 of the user's shoe size by drawing shoe size information 102 from a shoe size information database 104. Also optionally, the comparator component 42 may use the foot data 68 to determine and output the indicator 36 of the best fitting shoe from across a range of shoes 18 by drawing shoe information 106 from a shoe information database 108.

The foot data component 40 may optionally modify the foot data based on information received from the user 16. Such information includes sock thickness information. For example, if the user 16 intends to buy a sports shoe, and expects to wear thick sport socks with the sports shoe, then the foot data will be adjusted accordingly to account for the thickness of the sports sock. This foot data as modified will then be sent to the comparator component. If the software package stored the foot data, if may store either or both of the foot data without modification or the foot data with modification.

Figure 13:
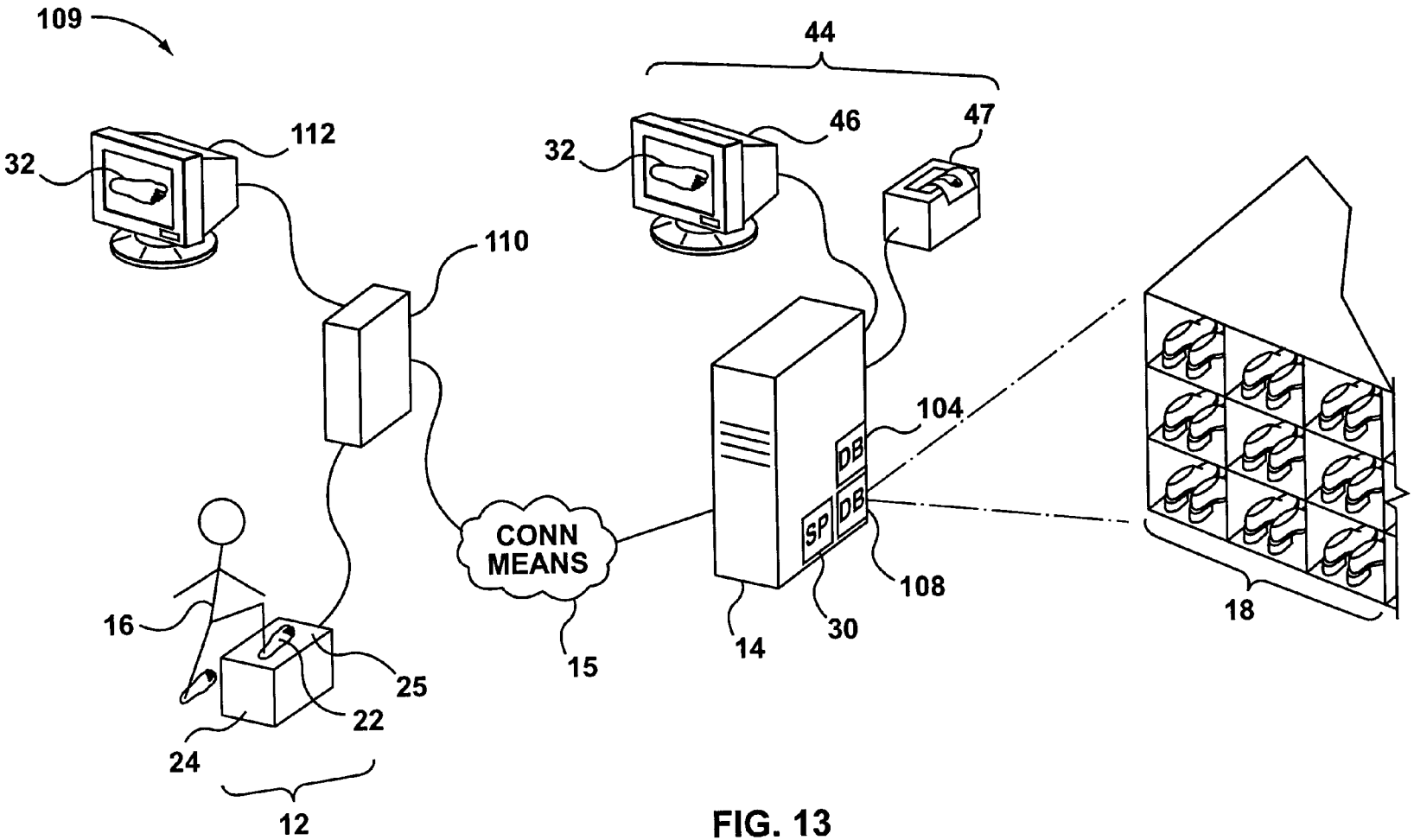
FIG. 13 is a view of a shoe sizing system in accordance with an alternative embodiment of the present invention.

Referring to FIG. 1, the connection means 15 may be any suitable connection means, such as a cable connecting the input device 12 to the computer 14. In an alternative configuration 109, shown in FIG. 13, the input device 12 may be a scanner connected to a second computer which is a user computer 110, and the connection means 15 may include the Internet. The user 16 may scan their foot 22 using a scanner 24 in their own home, for example, to produce the input image 20. The input image 20 may then be transmitted to the shoe sizing computer 14 via the Internet and possibly also via a local network to which the shoe sizing computer 14 may be connected. The shoe sizing computer 14 can then process the input image 20 as described above. In this alternative configuration, the shoe sizing computer 14 may transmit the outline 70 (or other suitable foot image) to the user computer 110 via the Internet for display on an output device 112 (e.g. a monitor) connected to the user computer 110. This permits the user 16 to adjust the rotational alignment of the outline 70 (or other suitable foot image) remotely. Alternatively, the connection means 15 may be a wireless connection means 15 to connect the input device 12 and the computer 14, and may include a wireless connection through the Internet.

It has been described for the software package 30 to include an image processing component, a foot data component and a comparator component. It is alternatively possible that the software package would not include the comparator component. In this embodiment, the software package 30 generates the foot data 68, which are the actual dimensions of the foot 22. These foot data 68 may be outputted to the user 16, or they may be stored or used in any way that the user's shoe size would be used, since the foot data 68 are the dimensions of the user's foot 22 in standard units of length, e.g, inches or centimeters.

It has been described for the software package 30 to store a representation of the trace outline 32, or the trace outline 32 itself. These can be stored in a user information database, in a record for the user 16. The database may be optionally capable of storing a plurality of such representations or trace outlines 32 for each user 16, so that historical graphical foot-growth data can be obtained and viewed as described earlier.

It has been described for the comparator component 42 to compare the foot data 68 with shoe sizing information 102 drawn information from the shoe sizing information database 104, and produce and output an indicator 101 of the user's shoe size. It is alternatively possible however, that the comparator component 42 can calculate the shoe size of the user 16 instead of drawing information from the shoe sizing database 104. In this alternative, the shoe sizing information database is not required.

It has been described for the foot data component 40 to determine the foot data 68 and generate the modified trace outline 70 in a particular sequence of steps. Several of the steps however, may be performed in a different order than that described. For example, the step 308 of determining the forwardmost or toe point 92 may be taken immediately after copying the forward portion of the trace outline 32 into the modified trace outline 70 (step 300). Another example is that the B-spline curve in the inside arch region 100 may be drawn at step 318 before filling in the gap at step 314 on the outside of the foot 22 in the modified trace outline.

The software package 30 may be stored on any suitable computer readable medium such as a CD, a DVD, a ROM device, a hard drive, or a floppy disc.

While the above description constitutes the preferred embodiments, it will be appreciated that the present invention is susceptible to modification and change without departing from the fair scope of the invention.

We claim:

1. A method of sizing shoes on a foot, comprising:

obtaining a digital image of the foot;

generating a trace outline of the foot from the digital image;

deriving foot data from the trace outline;

comparing the foot data to corresponding data for a plurality of shoes; and outputting an indicator of the best fitting shoe from among the plurality of shoes based on the results of the comparison.

2. A method of sizing shoes as claimed in claim 1, further comprising approximating at least one portion of the trace outline with at least one mathematical curve.

3. A method of sizing shoes as claimed in claim 2, further comprising storing data relating to the at least one mathematical curve for visually representing the at least one portion of the trace outline.

4. A method of sizing shoes as claimed in claim 3, wherein the step of deriving foot data comprises deriving a plurality of foot data points from the trace outline, and the at least one mathematical curve is derived to match the trace outline at any foot data points in the at least one portion of the trace outline.

5. A method of sizing shoes as claimed in claim 2, wherein a heel portion of the trace outline is approximated by a half-ellipse.

6. A method of sizing shoes as claimed in claim 2, wherein an inside arch portion of the trace outline is approximated by a B-spline curve.

7. A method of sizing shoes on a foot, comprising:

obtaining a digital image of the foot;

generating a trace outline of the foot from the digital image;

deriving foot data from the trace outline; and outputting at least one of: the foot data and an indicator of shoe size based on the foot data.

8. A method of sizing shoes as claimed in claim 7, further comprising approximating at least one portion of the trace outline with at least one mathematical curve.

9. A method of sizing shoes as claimed in claim 8, further comprising storing data relating to the at least one mathematical curve for visually representing the at least one portion of the trace outline.

10. A method of sizing shoes as claimed in claim 9, wherein the step of deriving foot data comprises deriving a plurality of foot data points from the trace outline, and the at least one mathematical curve is derived to match the trace outline at any foot data points in the at least one portion of the trace outline.

11. A method of sizing shoes as claimed in claim 8, wherein a heel portion of the trace outline is approximated by a half-ellipse.

12. A method of sizing shoes as claimed in claim 8, wherein an inside arch portion of the trace outline is approximated by a B-spline curve.

13. A system for sizing shoes for the foot of a user, comprising:

a computer adapted to receive a digital image of the foot, the computer having stored thereon a software package, the software package including an image processing component, wherein the image processing component is adapted for receiving the digital image of the foot and producing a trace outline of the foot, the software package including a foot data component, wherein the foot data component is adapted to receive the trace outline and determine foot data from the trace outline.

14. A system for sizing shoes as claimed in claim 13, wherein the software package has a comparator component and the comparator component is adapted to receive the foot data and generate, based on the foot data, at least one of an indicator of the shoe size of the foot and an indicator of the best fitting shoe from among a plurality of shoes.

15. A system for sizing shoes as claimed in claim 14, wherein the computer is adapted to access a shoe information database, and the comparator component is adapted to compare the foot data with corresponding data for at least one shoe in the shoe information database.

16. A system for sizing shoes as claimed in claim 13, wherein the foot data comprises at least one of: the foot length, the foot width, the metatarsal length and the heel width.

17. A system for sizing shoes as claimed in claim 13, wherein the foot data comprises all of the foot length, the foot width, the metatarsal length and the heel width.

18. A system for sizing shoes as claimed in claim 13, wherein the software package is adapted to store a representation of the trace outline on a computer readable memory.

19. A system for sizing shoes as claimed in claim 13, further comprising an input device for generating the digital image of the foot, wherein the input device is connected to the computer.

20. A system for sizing shoes as claimed in claim 19, wherein the input device is a scanner.

21. A system for sizing shoes as claimed in claim 13, wherein the computer is a shoe sizing computer, the input device is a scanner and a second computer, the scanner is connected to the second computer, and the second computer is connected to the shoe sizing computer.

22. A system for sizing shoes as claimed in claim 13, wherein the second computer is connected to the shoe sizing computer via the Internet.

* * * * *